US009259603B2

(12) United States Patent
Wireman

(10) Patent No.: US 9,259,603 B2
(45) Date of Patent: Feb. 16, 2016

(54) PORTABLE SPOTTING ASSISTANCE MACHINE

(71) Applicant: SAM Spotting Systems, L.L.C., Comstock Park, MI (US)

(72) Inventor: Justin Wireman, Comstock Park, MI (US)

(73) Assignee: SAM Spotting Systems, L.L.C., Comstock Park, MI (US)

( * ) Notice: Subject to any disclaimer, the term of this patent is extended or adjusted under 35 U.S.C. 154(b) by 168 days.

(21) Appl. No.: 14/068,530

(22) Filed: Oct. 31, 2013

(65) Prior Publication Data

US 2014/0121063 A1 May 1, 2014

Related U.S. Application Data

(60) Provisional application No. 61/720,630, filed on Oct. 31, 2012.

(51) Int. Cl.

| | |
|---|---|
| ***A63B 26/00*** | (2006.01) |
| ***A63B 5/16*** | (2006.01) |
| ***A63B 71/02*** | (2006.01) |
| ***A45F 3/24*** | (2006.01) |
| *A63B 21/055* | (2006.01) |
| *A63B 21/00* | (2006.01) |

(52) U.S. Cl.

CPC ... *A63B 5/16* (2013.01); *A45F 3/24* (2013.01); *A63B 71/023* (2013.01); *A63B 21/00065* (2013.01); *A63B 21/00069* (2013.01); *A63B 21/00181* (2013.01); *A63B 21/0552* (2013.01); *A63B 2005/163* (2013.01); *A63B 2071/025* (2013.01); *A63B 2210/50* (2013.01)

(58) Field of Classification Search

CPC ..... A63B 21/00; A63B 21/00065; A63B 21/00069; A63B 21/055; A63B 21/0552; A63B 69/00; A63B 5/16

USPC ..... 482/23, 41, 43, 118, 142, 143, 148

See application file for complete search history.

(56) References Cited

U.S. PATENT DOCUMENTS

| | | | | |
|---|---|---|---|---|
| 531,727 | A * | 1/1895 | Keegan et al. | A45F 3/24 5/128 |
| 711,579 | A * | 10/1902 | Morehouse | A47C 3/0255 5/129 |
| 3,476,385 | A * | 11/1969 | Foy | A63J 5/12 212/74 |

(Continued)

FOREIGN PATENT DOCUMENTS

| | | |
|---|---|---|
| WO | 2007/146829 | 12/2007 |

*Primary Examiner* — Stephen Crow
*Assistant Examiner* — Garrett Atkinson
(74) *Attorney, Agent, or Firm* — Gardner, Linn, Burkhart & Flory, LLP

(57) ABSTRACT

A portable spotting apparatus includes a pair of support assemblies positioned a distance from each other to define a spotting area for a user. The support assemblies each have an upright member that includes a top portion coupled with a pulley and a bottom portion configured to rest on a floor surface. A pair of legs each have an upper end coupled with an intermediate portion of the upright member and a lower end configured to rest on the floor surface on opposing lateral sides of the upright member. At least one cord is configured to extend over the pulley and to couple with a harness for spotting the user in the spotting area. A cross member is coupled between lower regions of the support assemblies to maintain the distance between the support assemblies.

20 Claims, 13 Drawing Sheets

(56) References Cited

U.S. PATENT DOCUMENTS 3,937,461 A * 2/1976 Lew ..... A63B 7/02 182/6
4,052,070 A * 10/1977 Lew ..... A63B 7/00 482/96
4,431,184 A * 2/1984 Lew ..... A63B 7/00 482/102
4,976,623 A * 12/1990 Owsley ..... A63B 69/0064 434/247
5,003,652 A * 4/1991 Bayless ..... A45F 3/24 5/122
5,064,191 A * 11/1991 Johnson ..... A61H 1/006 472/135
5,178,590 A * 1/1993 Stephens ..... A63B 7/02 482/23
5,221,241 A * 6/1993 Bare, II ..... A63B 69/0064 482/124
5,392,476 A * 2/1995 Williams ..... A45F 3/24 248/166
5,403,253 A * 4/1995 Gaylord ..... A63B 21/068 482/140
5,421,783 A * 6/1995 Kockelman ..... A63B 5/16 472/131
5,649,866 A * 7/1997 Balwanz ..... A63G 9/00 472/118
5,983,422 A * 11/1999 Bayless ..... A45F 3/24 5/120
6,554,747 B1 * 4/2003 Rempe ..... A63B 21/04 482/38
6,669,609 B2 * 12/2003 Gerschefske ..... A63B 21/1457 482/123
7,651,450 B2 * 1/2010 Wehrell ..... A61H 1/0229 482/124
7,996,935 B1 * 8/2011 Chen ..... A45F 3/22 5/120
2004/0116195 A1 * 6/2004 Lee ..... A47C 3/0255 472/118
2006/0270523 A1 * 11/2006 Lettelleir ..... A63B 4/00 482/23
2007/0287599 A1 * 12/2007 Chartrand ..... A63B 21/1419 482/23

* cited by examiner

PORTABLE SPOTTING ASSISTANCE MACHINE

CROSS-REFERENCE TO RELATED APPLICATION

The present application claims the benefit under 35 U.S.C. §119(e) of provisional application Ser. No. 61/720,630, filed Oct. 31, 2012, entitled PORTABLE SPOTTING ASSISTANCE MACHINE, the entire contents of which are hereby incorporated by reference.

FIELD OF THE INVENTION

The present invention generally relates to a portable spotting apparatus, and more particularly relates to portable equipment for spotting and training users within a spotting area.

BACKGROUND OF THE INVENTION

It is common for individuals attempting skilled athletic maneuvers, such a flip or other acrobatic motion, to desire spotting assistance when practicing or first attempting such a maneuver. However, it is generally understood that human spotters may occasionally make an error when spotting or may become fatigued from spotting, which can result in the spotter making mistakes that may injure the spotter or the person being spotted. To avoid inconsistent or otherwise unsafe spotting done by humans, devices have been created that are designed to assist a human spotter and, in some instances, entirely replace the human spotter. Typically, these spotting devices require affixing the device to a permanent structure, such as an I-beam or roof truss. Other spotting devices that are not fixed are commonly large and cumbersome, lacking the ability to fold or collapse for storage or transportation. Also, previous spotting devices generally failed to provide adjustments or calibrations for the skill level of the user.

SUMMARY OF THE INVENTION

According to one aspect of the present invention, a portable spotting apparatus includes a pair of support assemblies positioned a distance from each other to define a spotting area for a user. The support assemblies each have an upright member that includes a top portion coupled with a pulley and a bottom portion configured to rest on a floor surface. A pair of legs each have an upper end coupled with an intermediate portion of the upright member and a lower end configured to rest on the floor surface on opposing lateral sides of the upright member. At least one cord is configured to extend over the pulley and to couple with a harness for spotting the user in the spotting area. A cross member is coupled between lower regions of the support assemblies to maintain the distance between the support assemblies.

According to another aspect of the present invention, a portable spotting apparatus includes a support assembly movable between a collapsed position and a use position. The support assembly is configured to be arranged in the use position with an additional support assembly to define a spotting area for a user. The support assembly includes a cross member configured to extend across the spotting area adjacent to a corresponding cross member of the additional support assembly. An upright member has a bottom portion pivotally coupled with the cross member. The spotting area is further defined between the upright member and a corresponding upright member of the additional support assembly. A pair of legs each have an upper end pivotally coupled with an intermediate portion of the upright member and a lower end configured to rest on the floor surface on opposing lateral sides of the upright member in the use position. At least one cord is coupled with a top portion of the upright member and is configured to couple with a harness for spotting the user.

According to yet another aspect of the present invention, a support assembly for a portable spotting apparatus includes a cross member configured to extend across a spotting area. An upright member has a top portion coupled with a pulley and a bottom portion pivotally coupled with the cross member. A pair of legs each have an upper end pivotally coupled with an intermediate portion of the upright member. The pair of legs are each pivotal between a deployed position with a lower end of the pair of legs configured to rest on the floor surface on opposing lateral sides of the upright member and a folded position with the pair of legs adjacent to the upright member. At least one cord operably engaging the pulley and is configured to couple with a harness for spotting a user and to provide a tension on the harness that is adjustable between higher and lower tensions corresponding to higher and lower upward force on the harness. A wheel is rotatably coupled with the horizontal member proximate the bottom portion of the vertical member for transporting of the support assembly in a collapsed position. The support assembly is movable between a use position and the collapsed position, which includes the vertical member in generally parallel alignment with the horizontal member and the pair of legs in the folded position.

These and other features, advantages, and objects of the present invention will be further understood and appreciated by those skilled in the art by reference to the following specification, claims, and appended drawings.

DETAILED DESCRIPTION

Figure 1:
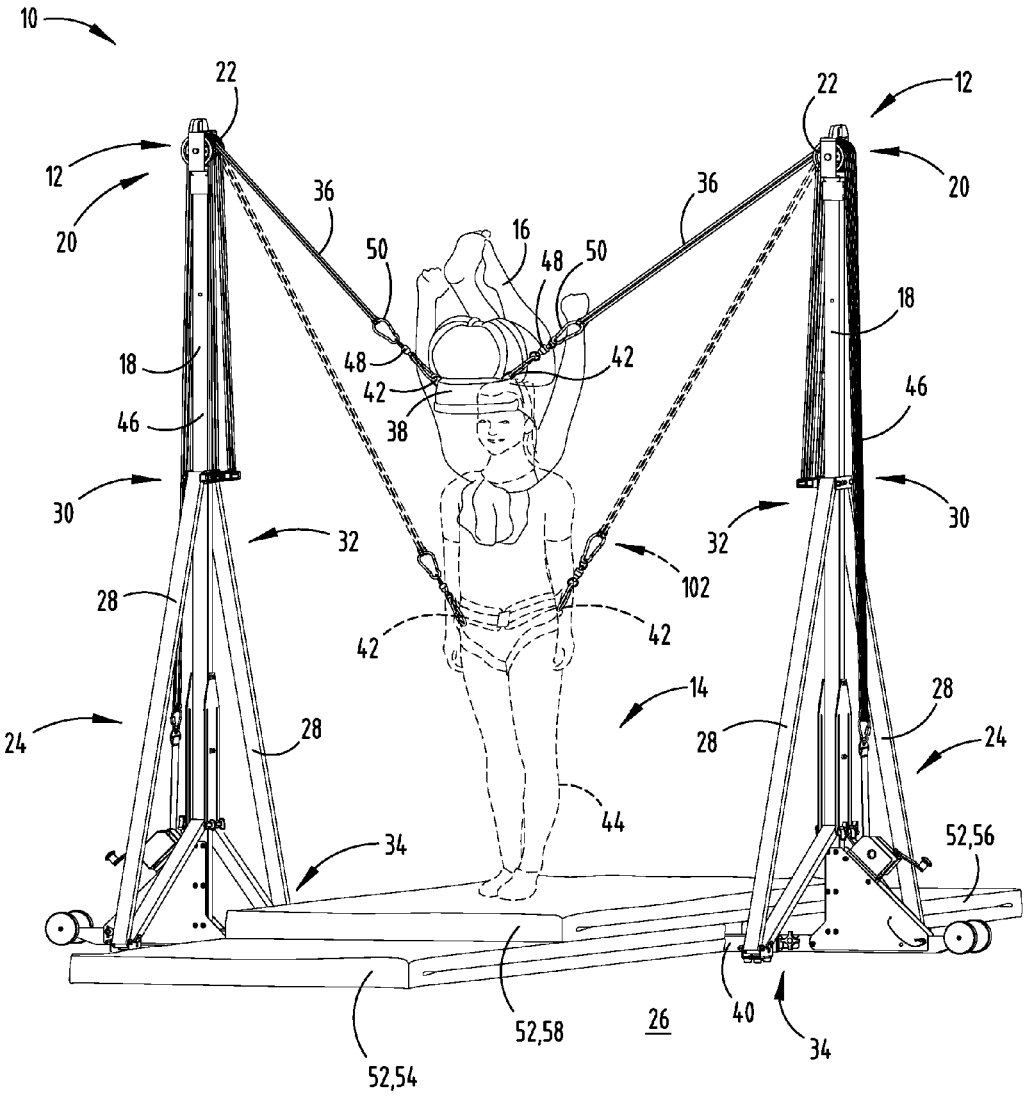
FIG. 1 is a top perspective view of a portable spotting apparatus with a user being spotted in a spotting area with a plurality of cords, according to one embodiment of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to FIGS. 1-15, reference numeral 10 generally designates one embodiment of a portable spotting apparatus that includes a pair of support assemblies 12 positioned a distance from each other to define a spotting area 14 for a user 16. The support assemblies 12 each have an upright member 18 that includes a top portion 20 coupled with a pulley 22 and a bottom portion 24 configured to rest on a floor surface 26. A pair of legs 28 each have an upper end 30 coupled with an intermediate portion 32 of the upright member 18 and a lower end 34 configured to rest on the floor surface 26 on opposing lateral sides of the upright member 18. At least one cord 36 is configured to extend over the pulley 22 and to couple with a harness 38 for spotting the user 16 in the spotting area 14. A cross member 40 extends along the floor surface 26 and is coupled between lower regions of the support assemblies 12 to maintain the distance between the support assemblies 12.

Referring now to FIG. 1, the user 16 of the portable spotting apparatus 10 is located in the spotting area 14 performing an athletic movement with spotting assistance from the portable spotting apparatus. The user 16 is wearing a harness 38 that secures around the user's waist and the upper portion of the user's 16 legs 28, providing an attachment point 42 on opposing lateral sides of the harness 38 proximate the user's waistline. With the use of the harness 38 in the illustrated embodiment, the user 16 is able to freely jump vertically along with the ability to flip and perform other athletic movements commonly done in gymnastics, cheerleading, dance, diving, circus performances, martial arts, and other conceivable sporting fields. It is conceivable that various harness arrangements may be used with the portable spotting apparatus 10, including those with additional straps secured to the upper torso of the user 16 and those with additional or alternatively located attachment points 42 on the harness 38. It is also contemplated that the harness 38 may include a metal ring around the user's waist with ball bearings slidably engaging the attachment points 42 to the metal ring to allow the user to perform athletic movements having twist and rotation.

Prior to or after jumping, as shown in FIG. 1, the user 16 is in a standing position 44 centrally within the spotting area 14. In the standing position 44, the harness on the user 16 is generally centered laterally between the upright members 18 of the opposing support assemblies 12. As such, a plurality of cords 46 extend downward a substantially equal distance from each of the top portions 20 of the opposing upright members 18 and engage the outside lateral attachment points 42 of the harness 38, which include a rotatable connection provided by a rotatable element 48 attached between the harness 38 and a carabiner clip 50 in the illustrated embodiment. The plurality of cords 46 provide generally equal and constant tension on the opposing sides of the harness 38 and thereby maintain the user's 16 lateral position centrally within the spotting area 14, including during airborne maneuvers that are unbalanced or directed away from the central position between the upright members 18. The equal and constant tension in the plurality of cords 46 on opposing sides of the harness 38 also provides an upward bias on the harness 38, such that the user 16 may more easily jump and to ease or otherwise prevent the user 16 from falling and contacting a mat covering the floor surface 26 or other support surface.

As also illustrated in FIG. 1, the spotting area 14 is further defined by folded mats 52 that are arranged in the spotting area 14 over the floor surface 26 forward and rearward from the cross member 40 and spanning over the cross member 40. These mats may be standard folding gym mats with a soft foam interior and durable and pliable fabric material, such as vinyl-coated polyester, covering the foam interior or other types of mats generally known by one having ordinary skill in the art. A forward mat 54 and a rearward mat 56 are provided on opposing forward and rearward sides of the cross member 40 with a thickness that is substantially greater than the height of the cross member 40, which is defined by the distance of the upper facing surface of the cross member 40 away from the floor surface 26. A top mat 58 is placed over the upper facing surface of the cross member 40, spanning between the forward and rearward mats 56, such that the user 16 does is prevented from feeling the cross member 40 beneath the third mat when jumping or performing athletic maneuvers within the spotting area 14. It is conceivable that other mat arrangements may be provided over the cross member 40 and floor surface 26 or that mats may be omitted from the spotting area 14, such as when the maneuvers being performed by the user 16 do not interfere with the cross member 40.

Figure 2:
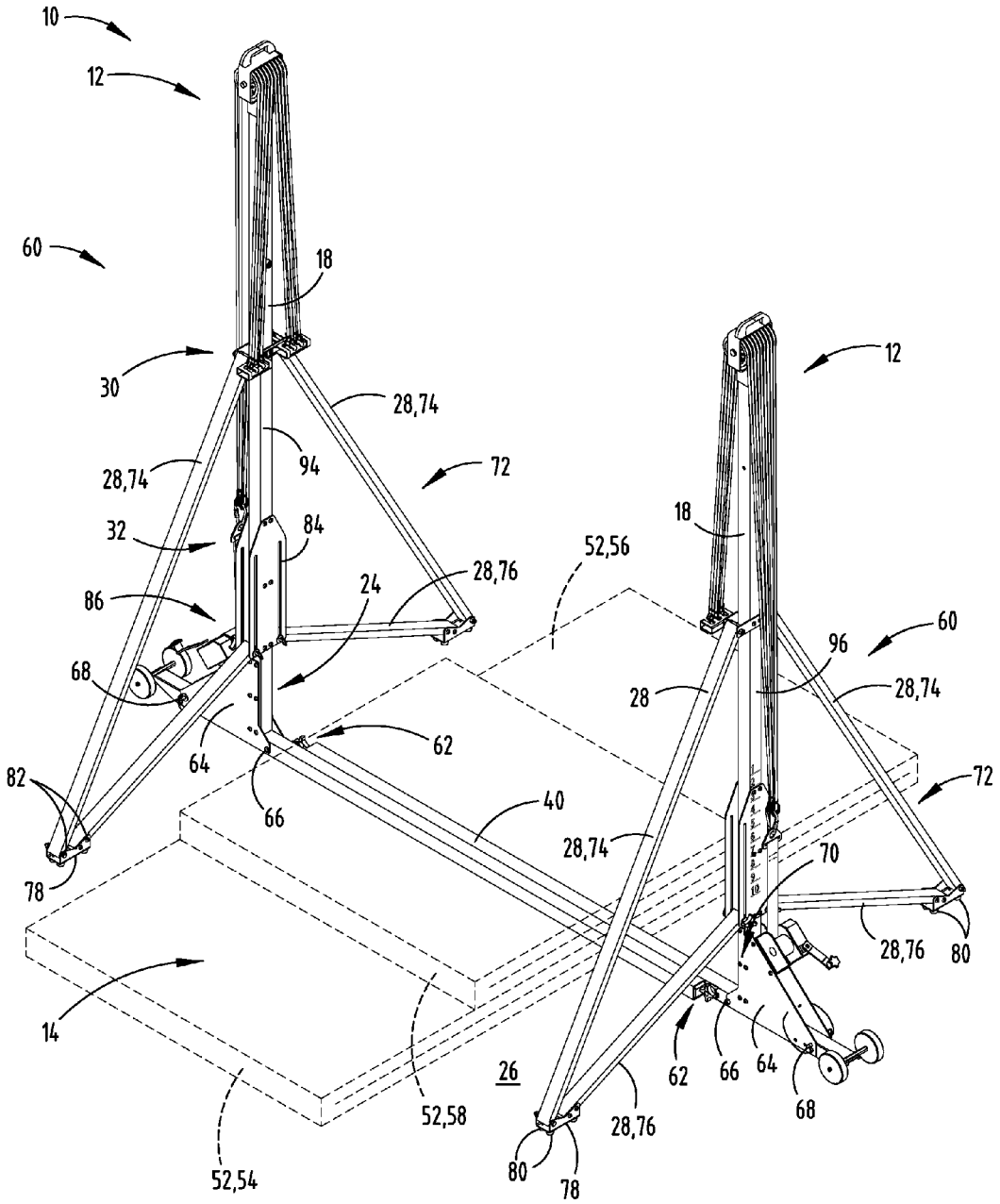
FIG. 2 is a top perspective view of the portable spotting apparatus, showing a pair of support assemblies attached together to define the spotting area and the plurality of cords held in a non-use position.

As shown in FIG. 2, the pair of support assemblies 12 are arranged in a use position 60 and mated together, such that a cross member 40 of each support assembly extends across the spotting area 14 adjacent to the cross member 40 of the corresponding support assembly. A distal end 62 of each cross member 40 couples with the corresponding cross member 40 proximate the bottom portion 24 of the upright member 18. The bottom portion 24 of the upright members 18 includes a base bracket 64 pivotally coupled with the cross member 40 at a first location 66 near the spotting area 14 and removably coupled with the horizontal member at a second location 68 further away from the spotting area 14. The base bracket 64 extends upward from the cross member 40 to fixedly attach along a lower region 70 of the upright member 18, such that the base bracket 64 forms a generally triangular shape to provide longitudinal support for holding the upright member 18 in the use position 60 with a substantially vertical orientation.

Still referring to the embodiment illustrated in FIG. 2, the intermediate portion 32 of the upright members 18, above the base bracket 64, include the pair of legs 28 that extend laterally from the upright member 18 in a deployed position 72 to similarly provide lateral support for the upright member 18 in the use position 60. The pair of legs 28 each include a top member 74 and a bottom member 76 that are each pivotally coupled with the intermediate portion 32 of the upright member 18 at the upper end 30 and coupled with a foot 78 for resting on the floor surface 26 at the lower end 34. The foot 78 includes rubber tabs 80 that engage the floor surface 26 and two pivotal axis 82 that separately engage the top and bottom members 76. The upper end 30 of the bottom member 76 is slidably coupled within a slot 84 on the upright member 18 and is slidable within the slot 84 between a bottom position 86 when the legs 28 are in a deployed position 72 and a top position 88 (FIG. 14) when the legs 28 are in a folded position 90, as explained in more detail below. The slot 84 is formed in alignment with the length of the upright member 18 is formed through a pair of panels 92 attached to an inside surface 94 and an outside surface 96 of the upright member 18. It is contemplated that the legs 28 may be alternatively attached to the upright members 18 in additional embodiments, such as with clevis and pin attachment.

Figure 3:
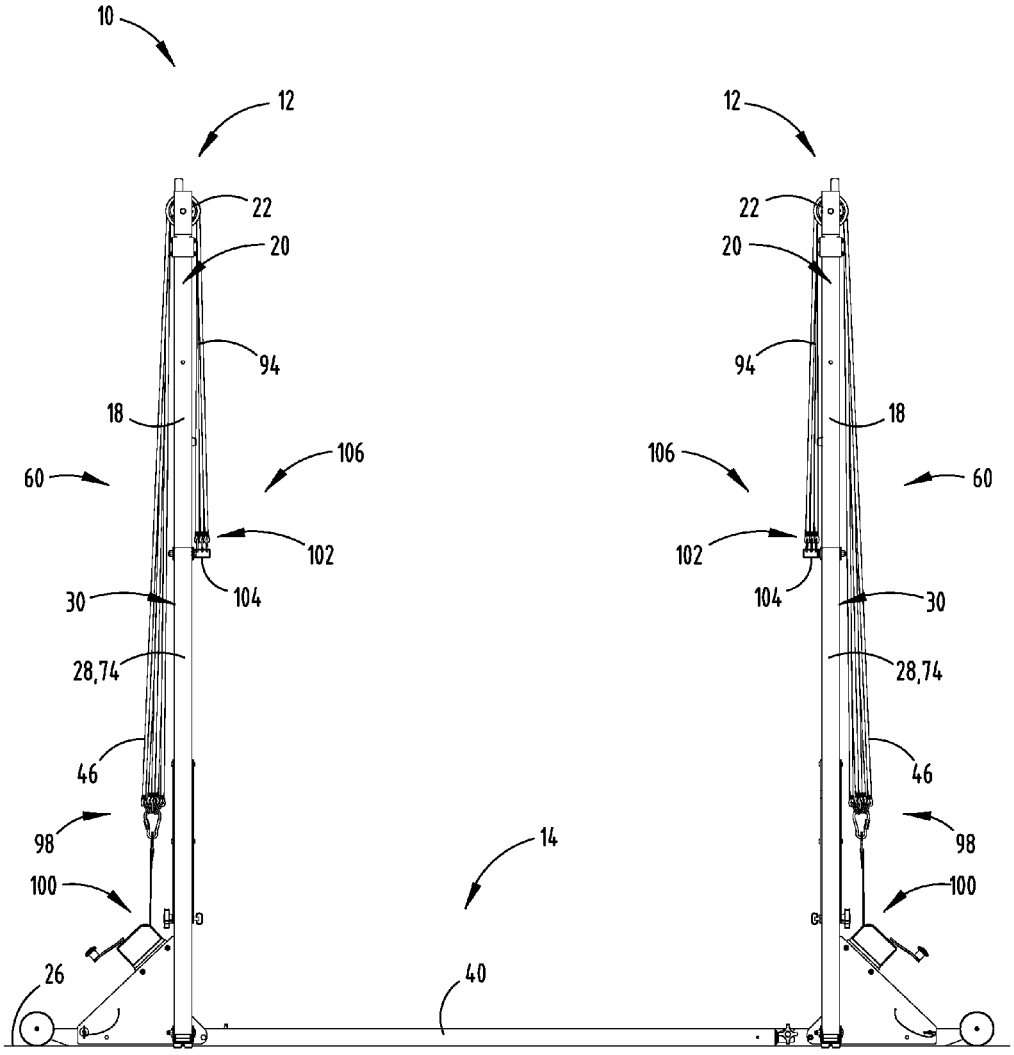
FIG. 3 is a side elevational view of the portable spotting apparatus.

With reference to FIG. 3, the plurality of cords 46 are shown extending between a first end 98 that is coupled with an adjustment device 100 and a second end 102 that is attached to a retention bracket 104 in a non-use position 106. The retention bracket 104 is coupled with the inside surface 94 of the upright member 18 proximate the upper end 30 of the top member 74 of the pair of legs 28. The second end 102 of the plurality of cords 46 may be detached from the retention bracket 104 and reattached to the harness 38 for use when spotting the user 16, as shown in FIG. 1 and explained above. The plurality of cords 46 extend over the top portion 20 of the upright member 18 and each engage a separate pulley 22 that is rotatably coupled therewith. The upright members 18 in the use position 60 support the pulleys 22 at an elevated location on the upright member 18 that is configured to be above the height of the user 16. Furthermore, the upright members 18 in the illustrated embodiment are substantially vertical in the use position 60 and perpendicular relative to the cross members 40, such that the upright members 18 are parallel to each other to define the spotting area 14 there between. It is conceivable that in additional embodiments the upright members 18 may be angled inward or outward relative to the spotting area 14.

Figure 4:
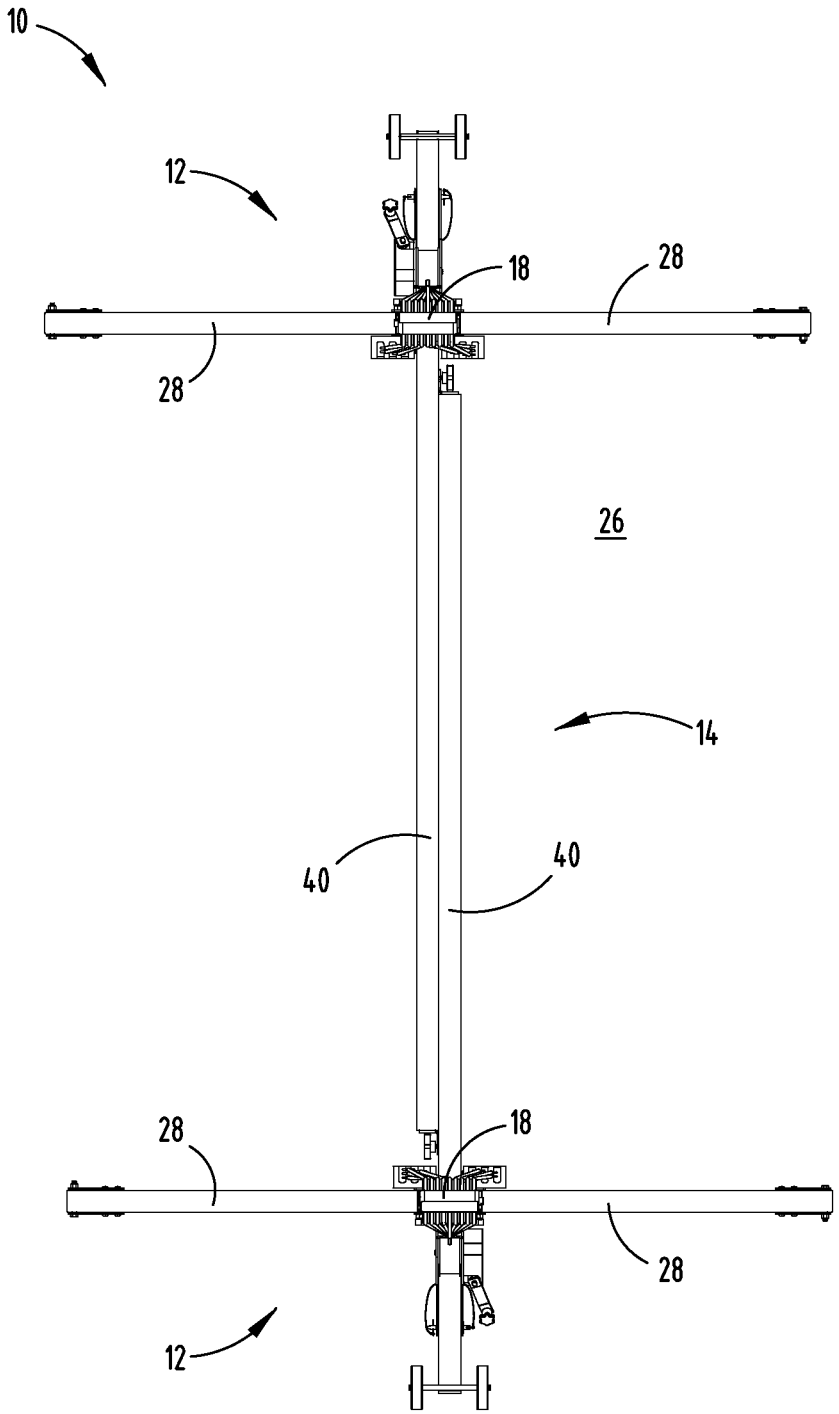
FIG. 4 is a top plan view of the portable spotting apparatus.

As illustrated in FIG. 4, the spotting area 14 is further defined between the pair of legs 28 extending laterally from each upright member 18 in general perpendicular alignment relative to the cross members 40. It further contemplated that in additional embodiments the pair of legs 28 may extend laterally at a forward or rearward angle relative to the respective upright member 18, such that the legs 28 may extend respectively inward or outward relative to the spotting area 14. As also shown, the cross members 40 of the support assemblies 12 extend immediately adjacent to one another spanning across the spotting area 14, such that the support assemblies 12 are laterally offset from each other by a distance equal to the width of one of the cross members 40. It is also understood that the cross members 40 in additional embodiments may span between other portions of the support assemblies 12 and may not be in consistent contact across the spotting area 14 or in contact with the floor surface 26. Furthermore, in additional embodiments the cross member may comprise a single member that extends between the upright members 18.

Figure 5:
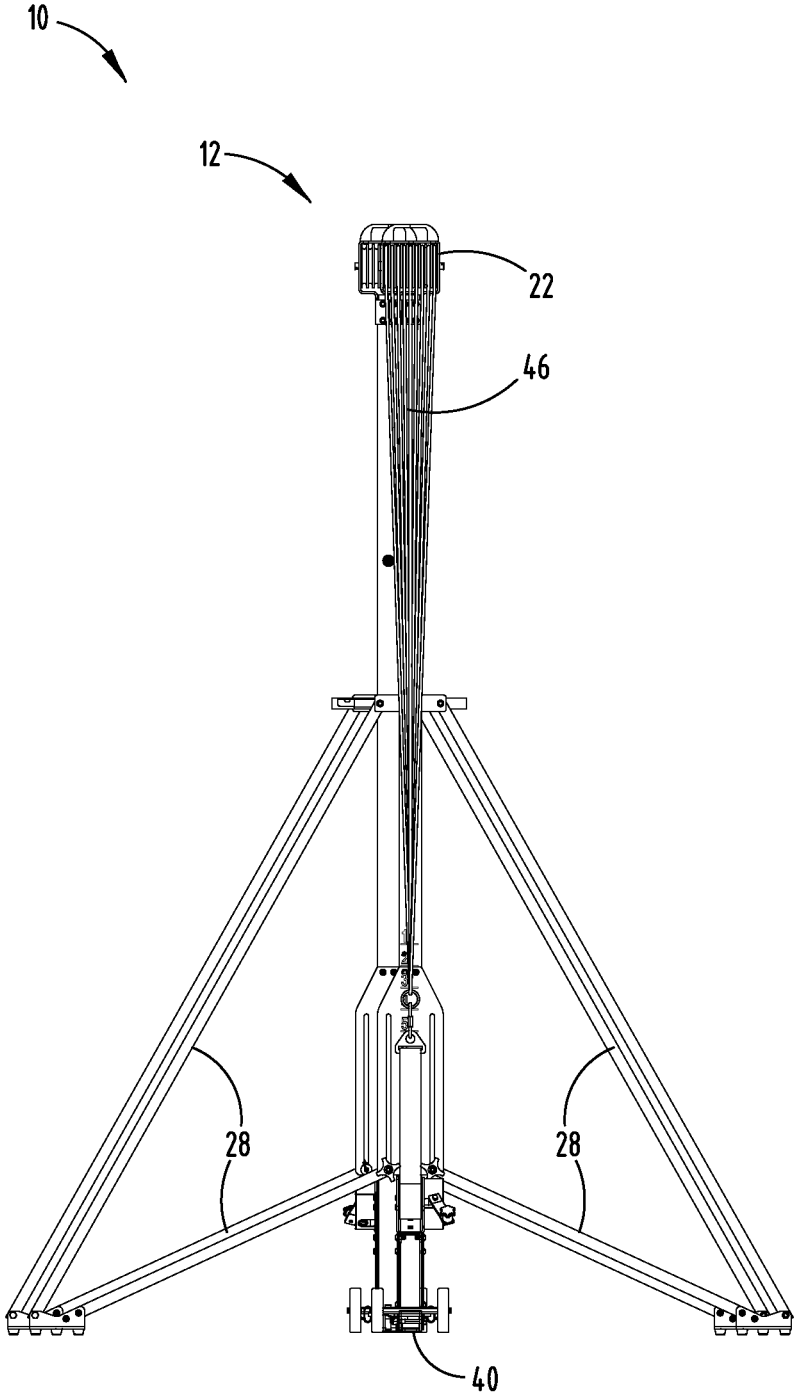
FIG. 5 is an end elevational view of the portable spotting apparatus.

As shown in an end view of one embodiment the spotting apparatus 10 that is illustrated in FIG. 5, the support assemblies 12 are offset laterally from each other by the width of the cross members 40, resulting in the plurality of cords 46 engaging the respective pulley 22 at an offset lateral location. The offset lateral locations also cause the second ends 102 (FIG. 1) of the plurality of cords 46 to engage the harness 38 (FIG. 1) at a slight angle, which is generally unnoticeable to the user 16 in the spotting area 14.

Figure 6:
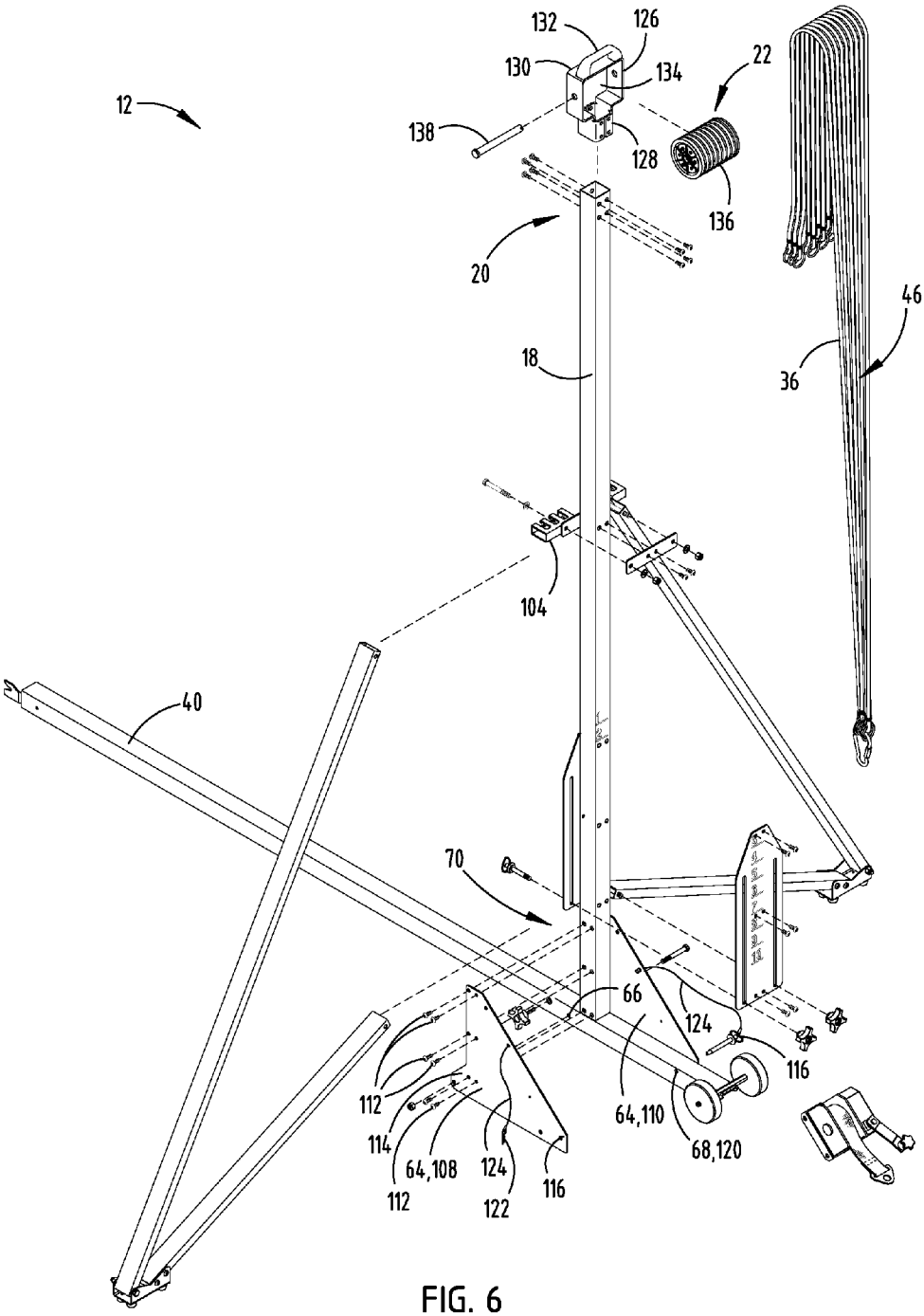
FIG. 6 is an exploded top perspective view of a single support assembly of the portable spotting apparatus.
Figure 14:
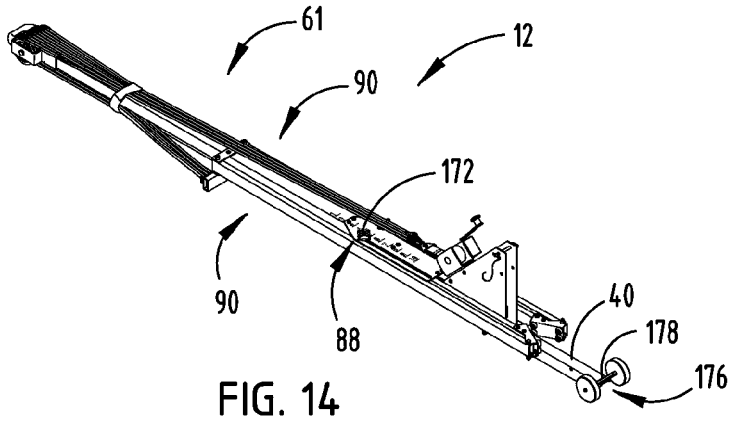
FIG. 14 is a top perspective view of the support assembly, showing the support assembly in the collapsed position, having the pair of legs in the folded position.

Referring now to FIG. 6, a single support assembly 12 is exploded, showing the upright member 18 is comprised of hollow metal tube with a square-shaped cross section. The cross member 40 is formed from a substantially identical hollow tube having a square-shaped cross section. The attachment between the upright member 18 and the cross member 40 is formed at the first and second locations 66, 68 on the cross member 40 with the base bracket 64. More specifically, the base bracket 64 includes a first plate 108 and a second plate 110 on opposing sides of the upright member 18 that are attached to the lower region 70 of the upright member 18 with a series of fasteners 112. It is contemplated that the base bracket 64 may be alternatively attached to the upright member 18, such as by welding, or may be integrally formed with the upright member 18. The base bracket 64 extends down from the upright member 18 and includes a forward projection 114 that pivotally couples with the cross member 40 at the first location 66 to allow the upright member 18 to pivot into parallel alignment with the cross member 40 in the collapsed position 61, as shown in FIG. 14 explained in more detail below. The base bracket 64 also extends rearward to detachably engage the cross member 40 at the second location 68 with an attachment pin 116 that extends through apertures 118 in the first and second plates 108, 110 of the base bracket 64 and a hole 120 that passes through the cross member 40. The attachment pin 116 is retained in the apertures 118 and the hole 120 with a cotter pin 122, and the attachment pin 116 and the cotter pin 122 are separately attached to the first and second plates 108, 110, respectively, with a lanyard 124 to prevent misplacement during the disengagement of the base bracket 64 at the second location 68.

Figure 15:
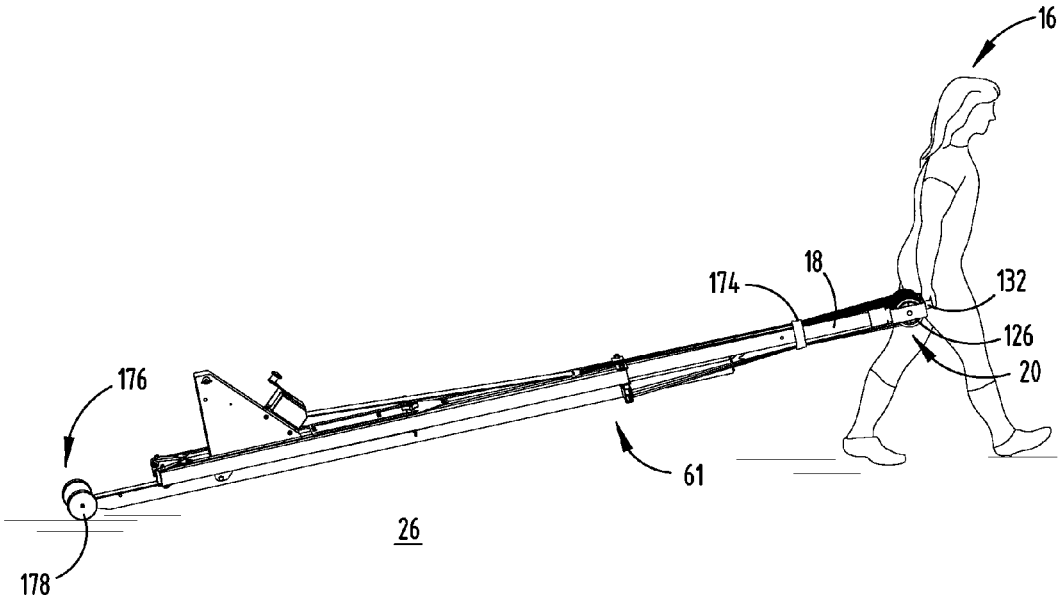
FIG. 15 is a top perspective view of the support assembly in the collapsed position being transported by a user raising one end and using a wheel on the other end of the collapsed support assembly.

As also illustrated in FIG. 6, the top portion 20 of the upright member 18 includes a pulley bracket 126 having a lower portion 128 that engages within the hollow interior of the upright member 18 to secure the pulleys 22. An upper portion 130 of the pulley bracket 126 includes a handle 132 that can be used for transporting the support assembly 12 in the collapsed position, as shown in FIG. 15. Between the upper and lower portions 130, 128 of the pulley bracket 126, an opening 134 is sized to receive each pulley 22, which in the illustrated embodiment includes a plurality of individual disk-shaped pulleys 22 that together define a pulley stack 136. The pulley stack 136 is rotatably engaged by a shaft 138 that extends across the opening 134 of the pulley bracket 126 and allows for separate rotation for each individual pulley 22. Each individual pulley 22 also includes a circumferential groove for retaining a single cord 36 of the plurality of cords 46. It is contemplated that in additional embodiments the pulleys 22 may be alternatively engaged to the top portion 20 of the upright member 18, such as with an alternatively shaped or attached pulley bracket 126.

Figure 7:
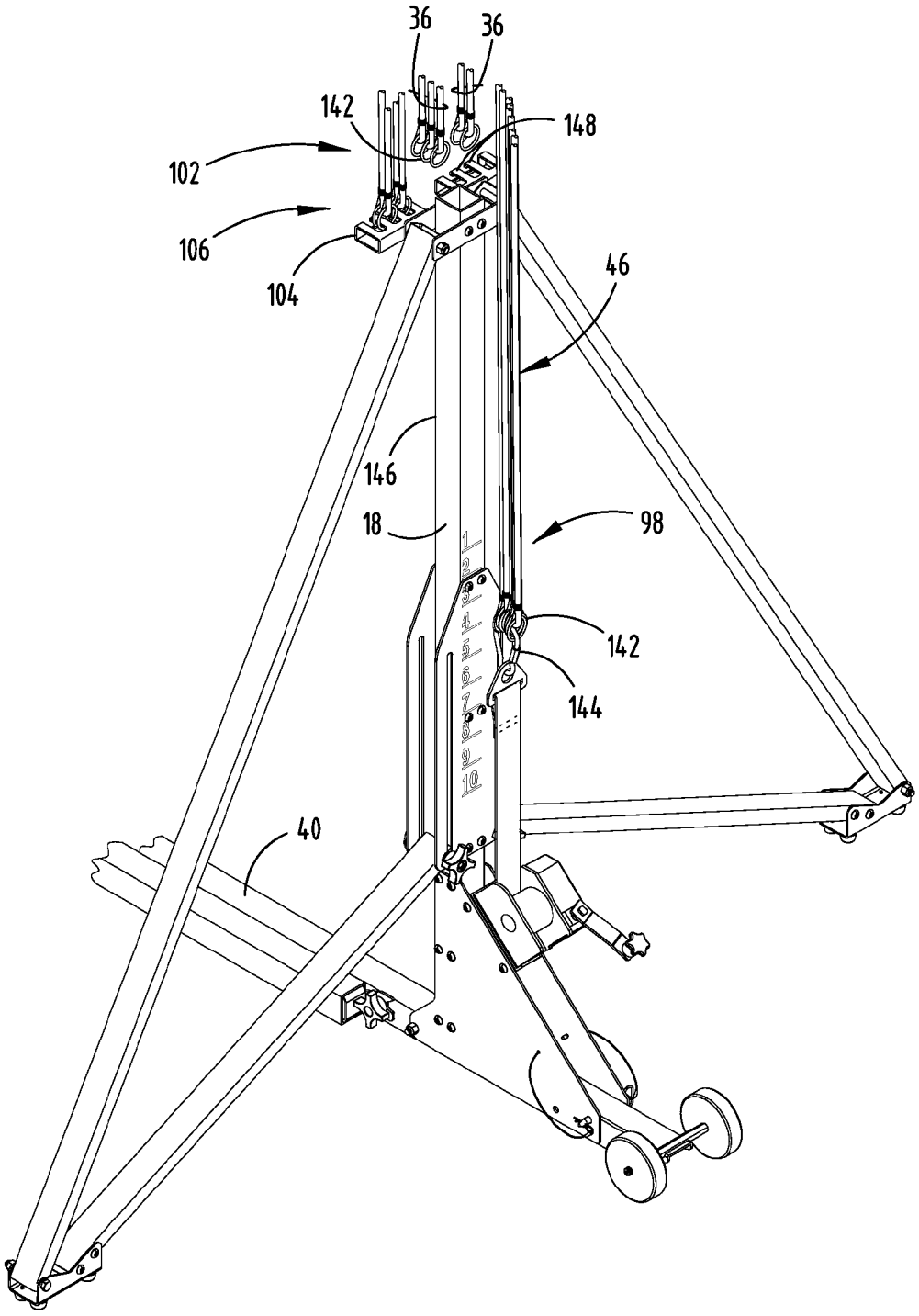
FIG. 7 is a sectional top perspective view of a lower region of the support assembly of the portable spotting apparatus.

As shown in FIG. 7, the plurality of cords 46 in the illustrated embodiment includes nine individual cords 36, or bungee cords, that have a metal ring 142 clamped at both ends. The elastomeric material of each individual cord 36 is wrapped with a nylon thread to protect the elastomeric material and to prevent over-stretching the elastomeric material. Specifically, stretching the cord 36 causes the nylon thread to tighten around the elastomeric material and ultimately synchs the elastomeric material at a maximum stretched length of the cord 36. The length of the plurality of cords 46 and the geometry of the spotting apparatus 10 is configured such that the maximum stretched length of each cord 36 is greater than the stretched length of each cord 36 when the harness 38 is touching the floor surface 26 (FIG. 1), thereby the maximum stretch length is not achieved during normal use of the spotting apparatus 10. It is contemplated that in additional embodiments the elastomeric material may be alternatively incorporated with the plurality of cords 46 or otherwise omitted, such that a single elastomeric material may be interposed between segments of each individual cord 36 or the cords 46 or that an alternative biasing device may be coupled between the harness 38 and the spotting apparatus 10 to provide spotting assistance to the user 16.

Still referring to FIG. 7, the metal rings 142 at the first end 98 of the plurality of cords 46 are coupled with an additional carabiner clip 144 that engages the adjustment device 100 and the metal rings 142 at the second end 102 are either engaged with the retention bracket 104 in the non-use position 106 or with the carabiner clip 50 rotatably attached to the harness 38 (FIG. 1) in a spotting position. The retention bracket 104 is coupled with an inner surface 146 of the upright member 18 and includes four hooks 148 for engaging the metal rings 142 when the elastomeric cords are attached in the non-use position 106. It is understood that the retention bracket 104 may be alternatively configured with various hook arrangements to secure the elastomeric cords in the non-use position 106. Accordingly, the user 16 may select how many of the plurality of cords 46 are necessary to attach to the harness 38 for achieving the desired level of spotting assistance. Stated differently, the user 16 can adjust the number of elastomeric cords by removing or adding to the number of cords attached to the harness 38 to accommodate the user's desired level of spotting assistance. For instance, when a higher level of spotting assistance is desired more of the elastomeric cords 36 may be removed from the non-use position 106 and attached to the user's 16 harness 38, and likewise the elastomeric cords may be disengaged from the harness 38 and returned to the non-use position 106 when less spotting assistance is desired.

In the illustrated embodiment, attachment of a single elastomeric cord 36 to the harness 38 from each support assembly 12 provides approximately 10-30 lbs. of upward force on the harness 38 for a user 16 generally between 5 and 6 feet tall, depending on the level of adjustment for each cord 36. Furthermore, the attachment of each cord 36 of the plurality of cords 46 defines a level of spotting assistance. Accordingly, in this embodiment, with all nine of the cords attached to the harness 38 from each support assembly 12, the highest level of spotting assistance is achieved and approximately between 150-250 lbs. of upward force is provided to harness 38, again depending on the level of tension adjustment for the cords. In additional embodiments, the amount of upward force is also dependent upon the type and length of cords, geometry of the overall spotting apparatus 10, size of the user 16, type of the harness 38, and other variables that can affect the level of spotting assistance. It is also contemplated that these variable may be adjusted in alternative embodiments, including adding to the number of elastomeric cords and varying the length and elastic properties of the cords.

Figure 8:
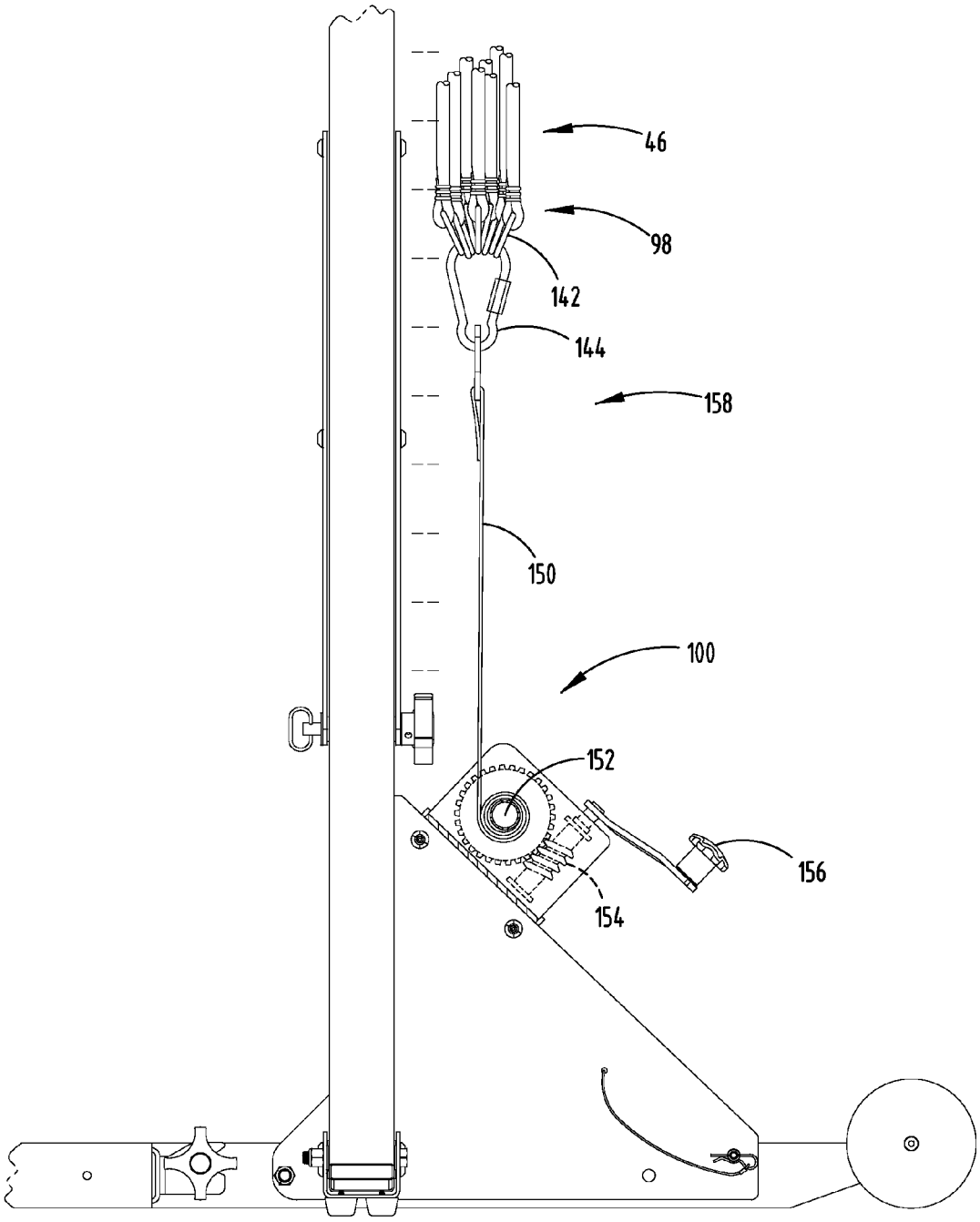
FIG. 8 is a side elevational view of the section of the portable spotting apparatus shown in FIG. 7, illustrating an adjustment device positioning a first end of the plurality of cords in an upper position.

Once a level of spotting assistance is selected, namely that a select number of the plurality of cords 46 are attached to the harness 38 (FIG. 1), the adjustment device 100, as shown in FIG. 8, may be adjusted to alter the amount of tension in the plurality of cords 46. The adjustment device 100 in the embodiment illustrated in FIG. 8 includes a strap 150 coupled with the first end 98 of the plurality of cords 46 and gathered around a rotatable spool 152 that interfaces with a worm gear 154. The worm gear 154 is operably attached to a crank 156 that rotates of the worm gear 154 to adjust the amount of the strap 150 wound on the spool. The worm gear 154 also prevents the spool 152 from rotating and unwinding the strap 150 when tension is on the plurality of cords 46. It is also contemplated that an alternative adjustment device may comprise a series of attachment locations spaced along the height of the upright member 18 that require the first end 98 to be detached and reattached at different attachment locations to adjust the tension in the plurality of cords 46. Also, an additional alternative adjustment device may comprise a winch that incorporates a paw-style latch that prevents the winch from unwinding when tension is on the plurality of cords 46. Other adjustment devices are also conceivable by one having ordinary skill in the art for adjusting the tension on the cords.

Figure 8A:
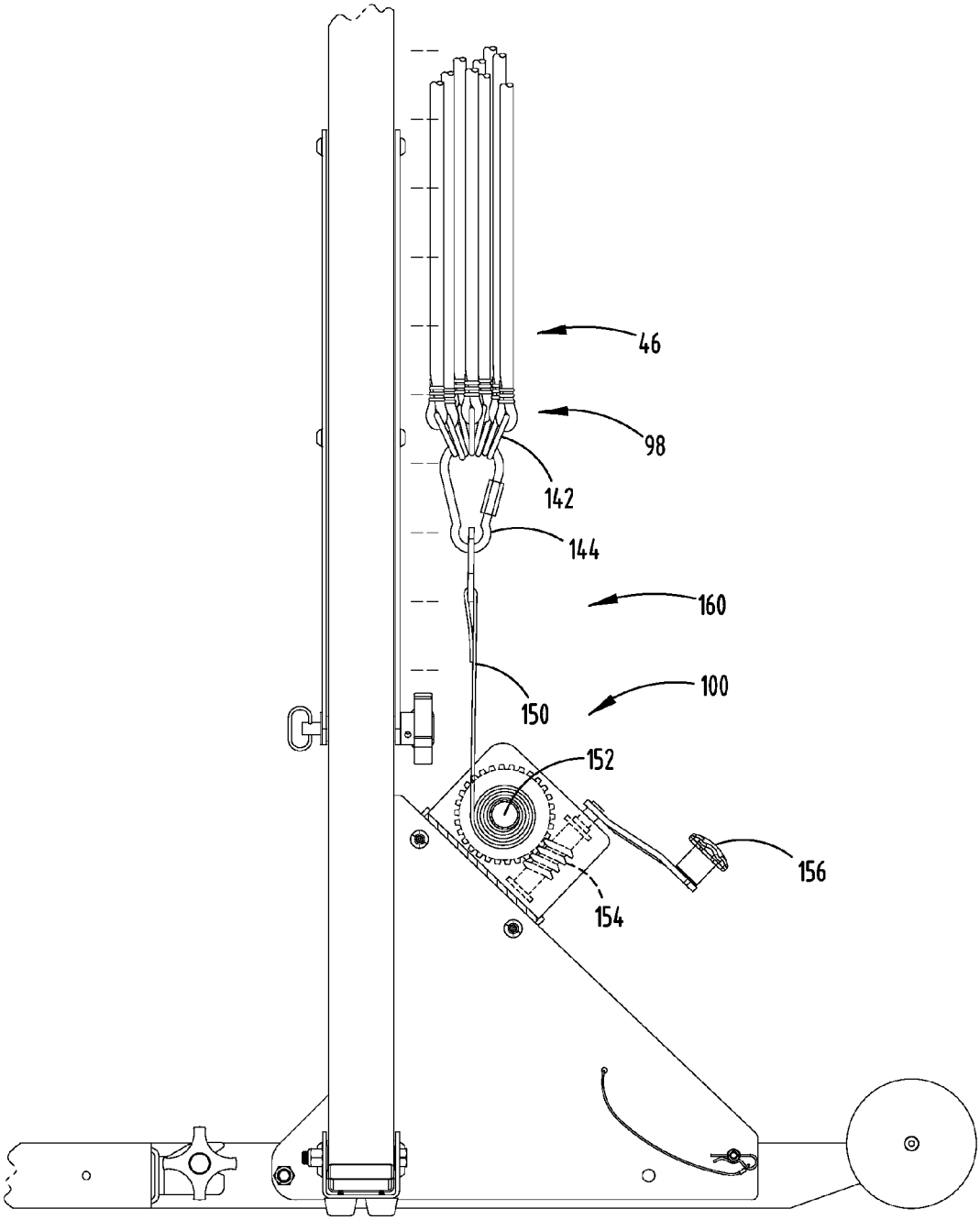
FIG. 8A is a side elevational view of the section of the portable spotting apparatus shown in FIG. 7, illustrating the adjustment device positioning the first end of the plurality of cords in a lower position.

As shown in FIGS. 8-8A, the illustrated embodiment of the adjustment device 100 is operable to move the first end 98 of the plurality of cords 46 between an upper adjustment position 158 (FIG. 8) and a lower adjustment position 160 (FIG. 8A), which is a further distance from to the pulleys 22 (FIG. 6) relative to the upper adjustment position 158 for providing more tension in the plurality of cords 46 and, therefore, more upward bias on the harness 38 (FIG. 1). More specifically, the adjustment device 100 may continuously adjust the first end 98 of the plurality of cords 46 between a variety of adjustment positions, as the strap 150 may be gradually released from or gathered on the spool 152 and held at any desired position with the worm gear 154 interface with the spool 152. The support assemblies 12 each include a separate adjustment device 100 that the user 16 moves to an adjustment position that is substantially the same between the adjustment devices 100 to provide a generally equal tension on the plurality of cords 46 for each support assembly 12. It is conceivable that in additional embodiments the adjustment devices 100 may include electric motors that are simultaneously actuatable, such as via wireless communication, to provide equal adjustment of the cords 46 on each support assembly 12.

Figure 9:
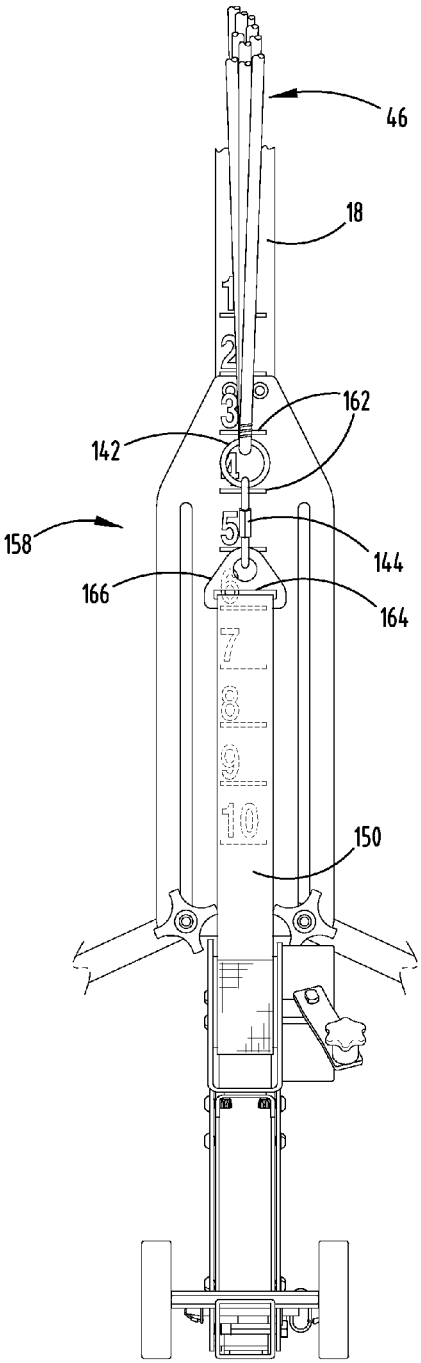
FIG. 9 is an end elevational view of a section of a portable spotting apparatus showing the adjustment device positioning the first end of the plurality of the cords in the upper position.
Figure 9A:
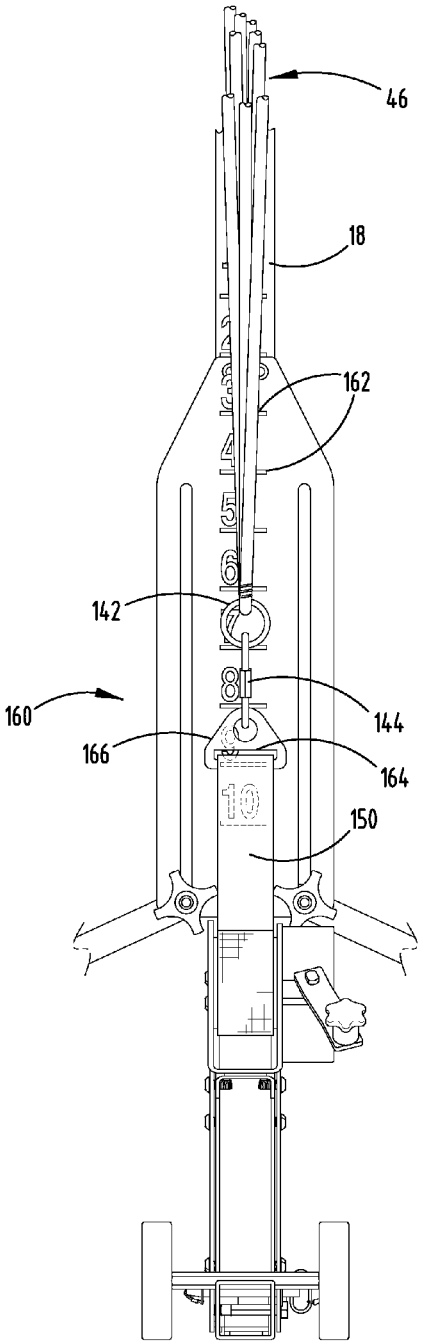
FIG. 9A is an end elevational view of the section of a portable spotting apparatus shown in FIG. 9, illustrating the adjustment device positioning the first end of the plurality of the cords in the lower position.

The movement of the first end 98 of the plurality of cords 46 between the upper and lower adjustment positions 158, 160, as illustrated in FIGS. 9-9A, is measured by a series of horizontal lines 162 marked at equally spaced locations on the upright member 18. In the illustrated embodiment, the horizontal lines 162 includes ten numbered lines that align with a linear aperture 164 in a connection feature 166 that couples between the strap 150 and the additional carabiner clip 144 on the first end 98 of the plurality of cords 46. Alignment of the linear aperture 164 with a select one of the horizontal lines 162 provides a visual measurement indication for adjusting the tension in the plurality of cords 46 equally for each support assembly 12. Other pointers or alignment marks may be formed on the strap 150, the cords, the additional carabiner clip 144, or other portion of the connection feature 166 for providing a visual measurement indication in other embodiments.

Figure 10:
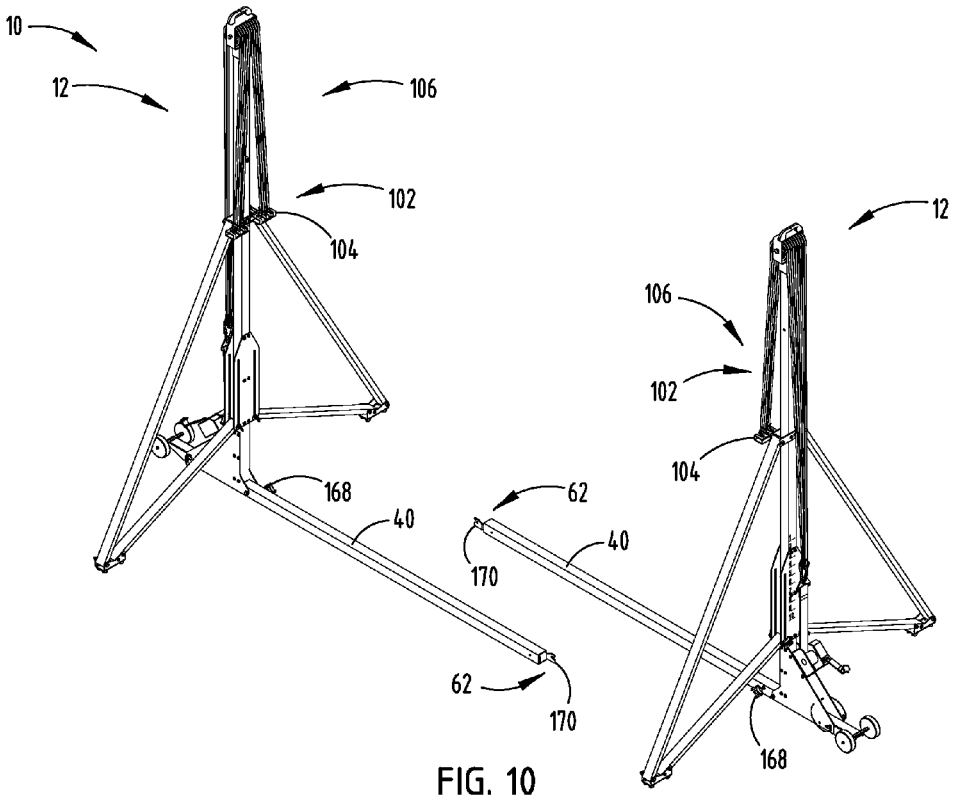
FIG. 10 is a top perspective view of the pair of support assemblies in the use position and detached from one another.
Figure 11:
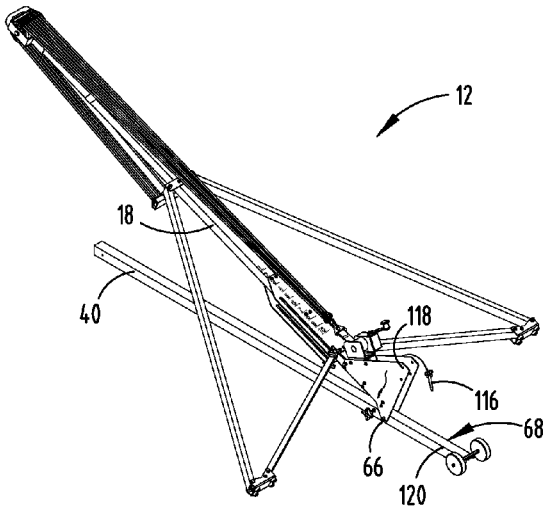
FIG. 11 is a top perspective view of the support assembly transitioning from the use position to a collapsed position, showing an upright member of the support assembly pivoting downward.
Figure 12:
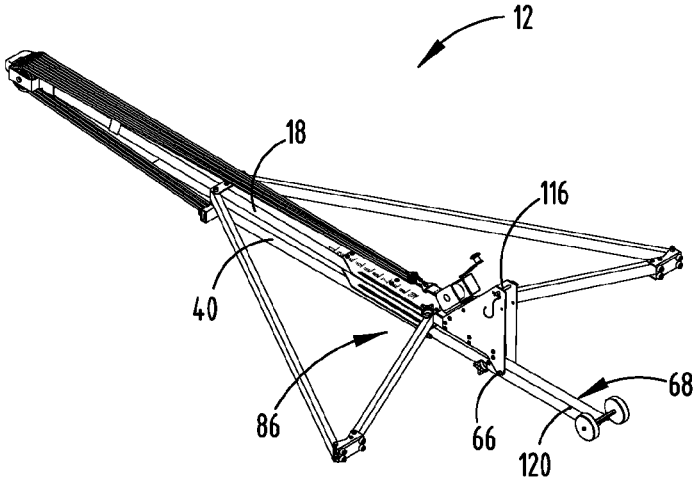
FIG. 12 is a top perspective view of the support assembly having the upright member pivoted into substantially parallel alignment with a cross member of the support assembly and a pair of legs remaining in a deployed position.

Referring now to FIGS. 10-12, the portable spotting apparatus 10 is transitioned out of the use position 60 (FIG. 1) and the support assemblies 12 are moved toward the collapsed position 61 (FIG. 14) for transportation or storage. More specifically, as shown in FIG. 10, the pair of support assemblies 12 are disengaged by loosening fasteners 168 attached to an outer surface of the cross members 40. The fasteners 168 each engage a fork-shaped bracket 170 on the distal ends 62 of the cross members 40 to secure the cross members 40 into abutting contact with each other for preventing the support assemblies 12 from becoming misaligned during use of the spotting apparatus 10. Loosening the fasteners 168 allows the fork-shaped brackets 170 to disengage and thereby allow each support assembly 12 to move individually to the collapsed position 61 (FIG. 14). When beginning to transition the support assembly 12 into the collapsed position 61 the second ends 102 of the plurality of cords 46 are all engaged with the retention bracket 104 in the non-use position 106.

With reference to FIGS. 11-12, the upright member 18 is pivoted from the generally vertical orientation (FIG. 10) to a generally horizontal orientation (FIG. 12) that places the upright member 18 in substantially parallel alignment with the cross member 40. To allow for pivotal movement of the upright member 18 about the first location 66 on the cross member 40, again the attachment pin 116 is removed from the apertures 118 in the base bracket 64 and the hole 120 in the cross member 40, proximate the second location 68. The attachment pin 116 may be reengaged with the apertures 118 in the support bracket upon disengaging the attachment at the second location 68.

Figure 13:
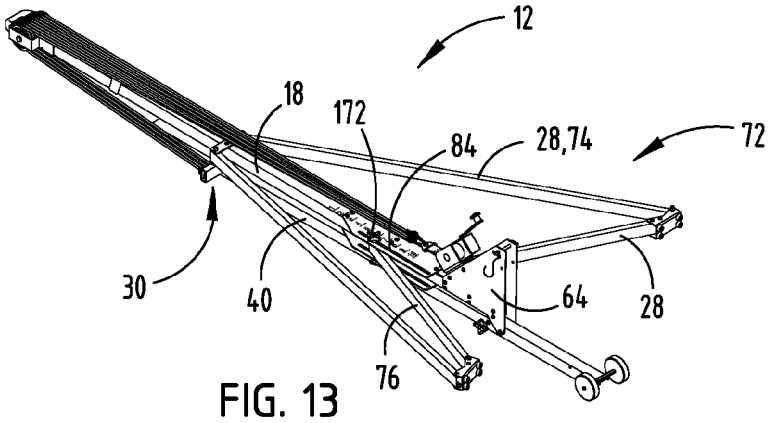
FIG. 13 is a top perspective view of the support assembly showing a leg of the pair of legs moving from the deployed position to a folded position.

Upon moving the upright member 18 into generally parallel alignment with the cross member 40, the pair of legs 28 are moved from the deployed position 72 to the folded position 90, as shown in FIGS. 13-14. In the deployed position 72, the legs 28 extend outward to support the upright member 18 in the use position 60 (FIG. 1). In the folded position 90, the top member 74 of the legs 28 is pivoted about the upper end 30 towards the base bracket 64 to extend in substantially parallel alignment with the upright member 18 in the collapsed position 61. Upon pivotal movement of the top member 74 of the legs 28, the upper end 30 of the bottom member 76 simultaneously pivots and slides downward within the slot 84 from the bottom position 86 (FIG. 12) to the top position 88, which is configured for the folded position 90 to place the bottom member 76 in parallel alignment and between the top member 74 and the upright member 18. A threaded engagement feature 172 is provided on the upper end 30 of the bottom member 76 that may be tightened to prevent sliding movement with the slot 84, such that the threaded engagement feature 172 may be tightened to secure the legs 28 in the deployed and folded positions 72, 90 and loosened to allow for slidable movement of the bottom member 76 in the slot 84.

As illustrated in FIGS. 14-15, the support assembly 12 is in the collapsed position 61. To hold the upright member 18 in parallel alignment with the cross member 40 for moving the support assembly 12, a band 174 is engaged around upright member 18, the cross member 40, and the plurality of cords 46. The band 174 may include a hook and loop type fastening means, such as Velcro, or other conceivable fastening means generally understood by one having ordinary skill in the art. Transportation of one of the support assemblies 12, as shown in FIG. 15, may be done by a user 16 lifting the top portion 20 of the upright member 18, specifically grasping the handle 132 on the pulley bracket 126. Raising the top portion 20 of the upright member 18 places a wheel 176 that is rotatably coupled with a proximal end of the cross member 40 into contact with the floor surface 26 for transporting of the support assembly 12 in the collapsed position. The wheel 176 includes two separate wheels attached to ends of an axel 178 that extends through the cross member 40. It is conceivable that the wheel 176 may be alternatively located on other portions of the support assembly 12 for also providing efficient transportation means of the support assembly 12. It is also understood that the described movements of the support assembly 12 to the collapsed position may be reversed to move the support assembly 12 back to the use position 60.

It will also be understood by one having ordinary skill in the art that construction of the described invention and other components is not limited to any specific material. Other exemplary embodiments of the invention disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the invention as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present invention. The exemplary structures and processes disclosed herein are for illustrative purposes and are not to be construed as limiting.

It is also to be understood that variations and modifications can be made on the aforementioned structure without departing from the concepts of the present invention, and further it is to be understood that such concepts are intended to be covered by the following claims unless these claims by their language expressly state otherwise.

The invention claimed is:

1. A portable spotting apparatus comprising:

a pair of support assemblies movable and deployable a distance from each other to define a spotting area for a user wearing a harness to perform an athletic maneuver, the support assemblies each comprising:

an upright member having a bottom portion configured to rest on a floor surface;

a pair of legs each having (i) a top member with an upper end pivotally coupled with an intermediate portion of the upright member and a lower end configured to rest on the floor surface on opposing lateral sides of the upright member, and (ii) a bottom member with a first end pivotally coupled with the upright member below the upper end of the top member and a second end coupled with the top member to support the top member in a deployed position, angling away from the upright member and resting on the floor surface;

a pulley assembly coupled with a top portion of the upright member; and a plurality of cords extending over the pulley assembly, each cord engaging a corresponding pulley of the pulley assembly, and configured to selectively engage the harness for spotting the user in the spotting area;

wherein at least one of the pair of support assemblies includes an elongated cross member pivotally coupled with the upright member and configured to span between lower regions of the support assemblies and across the spotting area to maintain the distance between the support assemblies.

2. The portable spotting apparatus of claim 1, wherein each support assembly includes a cross member pivotally coupled with the bottom portion of the upright member and extending longitudinally adjacent to a cross member of the other support assembly of the pair of support assemblies and attached therewith.

3. The portable spotting apparatus of claim 2, wherein the cross members are generally horizontal and in substantially perpendicular alignment to the pair of legs on each support assembly in the deployed position, and wherein a distal end of each cross member includes an engagement device that couples with the other cross member to hold the cross members in parallel adjacent engagement.

4. The portable spotting apparatus of claim 1, further comprising:

a wheel rotatably coupled proximate the bottom portion of each upright member for transporting of the support assemblies in a collapsed position, which includes pivoting the upright member and the pair of legs to be generally parallel with the cross member.

5. The portable spotting apparatus of claim 1, wherein the pulley assembly includes a plurality of pulleys rotatable about a common shaft, and wherein the pulley assembly is coupled with the upright member above a height of the user to provide a constant tension in the plurality of cords for biasing the harness upward.

6. The portable spotting apparatus of claim 5, wherein each of the plurality of cords engages a separate pulley of the plurality of pulleys and includes an elastomeric material configured to constantly bias the harness upward when spotting the user, and wherein a select number of the plurality of elastomeric cords is coupled with the harness to provide a selected level of spotting assistance.

7. The portable spotting apparatus of claim 1, further comprising:

a plurality of mats arranged in the spotting area and including (i) a pair of base mats on the floor surface on opposing sides of the double beam and (ii) a top mat spanning over the double beam to provide a cushioned surface in the spotting area.

8. The portable spotting apparatus of claim 1, wherein the support assemblies each further comprise:

an adjustment device coupled between a first end of each of the plurality of cords and the upright member and operable to adjust the amount of upward force on the harness.

9. The portable spotting apparatus of claim 8, wherein the adjustment device includes a spool that is rotatable to move the first end between a lower position and an upper position in closer proximity to the pulley assembly than the lower position for providing less upward bias on the harness.

10. The portable spotting apparatus of claim 1, wherein the second end of the bottom member of the pair legs slidably and pivotally engages the upright member, such that the second end of the bottom member slides away from the upper end of the top member when moving from a folded position toward the deployed position.

11. The portable spotting apparatus of claim 1, wherein the pair of legs each pivotally couple with the upright member and are movable between a deployed position extending outward to support the upright member and a folded position in generally parallel alignment with the upright member.

12. A portable spotting apparatus comprising:

a support assembly movable between a collapsed position and a use position and configured to be arranged in the use position with a second support assembly to define a spotting area for a user, the support assembly comprising:

a cross member having an elongated body with an engagement element at an end portion thereof, wherein the cross member is configured to extend across the spotting area adjacent to a corresponding cross member of the second support assembly and couple with an intermediate portion of the corresponding cross member via the engagement element to form a double beam that prevents the support assemblies from moving relative to each other in the use position;

an upright member having a bottom portion pivotally coupled with the cross member, wherein the spotting area is further defined between the upright member and a corresponding upright member of the second support assembly pivoted to generally perpendicular orientation relative to the double beam;

a pair of legs each having an upper end pivotally coupled with the upright member and a lower end configured to rest on a support surface on opposing lateral sides of the upright member in the use position;

a pulley assembly coupled with a top portion of the upright member and having a plurality of pulleys rotatable about a common horizontal axis; and a plurality of cords extending over the pulley assembly, each cord engaging a single dedicated groove of the plurality of pulleys, and configured to selectively couple with a harness worn by the user.

13. The portable spotting apparatus of claim 12, wherein the upright member is pivotal from generally perpendicular alignment with the cross member in the use position to generally parallel alignment with the cross member in the collapsed position.

14. The portable spotting apparatus of claim 12, wherein the pair of legs are each movable between a deployed position extending outward to support the upright member in the use position and a folded position extending adjacent to the upright member in the collapsed position.

15. The portable spotting apparatus of claim 14, wherein the pair of legs each includes a top member and a bottom member each pivotally coupled with the upright member at the upper end and coupled with a foot for resting on a floor surface at the lower end, and wherein the bottom member is configured to support the top member angled away from the upright member in the deployed position.

16. The portable spotting apparatus of claim 15, wherein the bottom member is slidably coupled within a slot on the upright member and is slidable within the slot between a bottom position when the legs are in the deployed position and a top position when the legs are in the folded position.

17. The portable spotting apparatus of claim 12, wherein the plurality of cords extend over the pulley assembly for coupling with the harness to provide a constant upward bias on the harness.

18. The portable spotting apparatus of claim 12, wherein the support assembly further comprises:

an adjustment device coupled between a first end of the plurality of cords and the upright member, wherein the adjustment device is operable to adjust the tension on plurality of cords, thereby adjusting the amount of upward force on the harness.

19. The portable spotting apparatus of claim 18, wherein the adjustment device includes a spool that is configured to rotate to move the first end of the plurality of cords downward to provide a greater upward force on the harness and upward to provide a lesser upward force on the harness.

20. A support assembly for a portable spotting apparatus, comprising:

a cross member having an engagement element at a distal end thereof and configured to extend across a spotting area and attach to a parallel and adjacent cross member of a second support assembly via the engagement element to prevent the support assemblies from moving relative to each other in a use position;

an upright member having a top portion coupled with a pulley assembly and a bottom portion pivotally coupled with the cross member;

a pair of legs each having (i) a top member with an upper end pivotally coupled with an intermediate portion of the upright member and (ii) a bottom member pivotally coupled with the upright member below the upper end of the top member, wherein the pair of legs are pivotal between a deployed position with a lower end of the top member supported by a floor surface on opposing lateral sides of the upright member and a folded position with the pair of legs adjacent to the upright member, and wherein the bottom member is configured support the top member angled away from the upright member in the deployed position;

a plurality of cords operably engaging the pulley assembly, wherein the at least one cord of the plurality of cords is configured to couple with a harness for spotting a user by providing a tension on the harness; and a wheel rotatably coupled with the cross member proximate the bottom portion of the upright member for transporting of the support assembly in a collapsed position, having the upright member in generally parallel alignment with the horizontal member and the pair of legs in the folded position.

* * * * *